US008905899B2

(12) United States Patent
Hansen

(10) Patent No.: US 8,905,899 B2
(45) Date of Patent: Dec. 9, 2014

(54) COMPONENT FOR WEIGHT-BEARING HEALTH EQUIPMENT SYSTEM AND METHOD OF USE

(75) Inventor: Dale Scott Hansen, Fort Wayne, IN (US)

(73) Assignee: Hansen Technologies, LLC, Fort Wayne, IN (US)

( * ) Notice: Subject to any disclaimer, the term of this patent is extended or adjusted under 35 U.S.C. 154(b) by 180 days.

(21) Appl. No.: 13/342,828

(22) Filed: Jan. 3, 2012

(65) Prior Publication Data

US 2013/0005540 A1 Jan. 3, 2013

Related U.S. Application Data

(60) Provisional application No. 61/429,099, filed on Dec. 31, 2010, provisional application No. 61/429,100, filed on Dec. 31, 2010, provisional application No. 61/429,105, filed on Dec. 31, 2010.

(51) Int. Cl.
*A63B 22/02* (2006.01)
*A63B 22/00* (2006.01)
*A63B 71/00* (2006.01)

(52) U.S. Cl.
CPC ..... *A63B 22/0235* (2013.01)
USPC ..... 482/54; 482/51

(58) Field of Classification Search
USPC ..... 482/51–54, 57–60, 66–72, 73–78; 119/700; D21/662, 668, 669, 670
See application file for complete search history.

(56) References Cited

U.S. PATENT DOCUMENTS

| | | | | |
|---|---|---|---|---|
| 4,708,337 | A * | 11/1987 | Shyu | 482/54 |
| 5,857,942 | A * | 1/1999 | Moon et al. | 482/54 |
| 6,607,469 | B2 * | 8/2003 | Ota | 482/54 |
| 7,462,139 | B2 * | 12/2008 | Stafiej et al. | 482/70 |
| 8,454,478 | B2 * | 6/2013 | Giannelli et al. | 482/52 |

(Continued)

FOREIGN PATENT DOCUMENTS

| | | |
|---|---|---|
| CN | 201279369 | 7/2009 |
| CN | 201930453 | 8/2011 |
| WO | 2010089618 A2 | 8/2010 |

OTHER PUBLICATIONS

Smooth Fitness 5.45 Folding Treadmill, http://www.amazon.com/Smooth-Fitness-5-45-Folding-Treadmill/dp/B0018KUDVW Accessed: Sep. 11, 2013. Date Saved on Wayback Machine: Feb. 16, 2009 accessed at www.archive.org.*

*Primary Examiner* — Oren Ginsberg
*Assistant Examiner* — Megan Anderson
(74) *Attorney, Agent, or Firm* — Taylor IP, P.C.

(57) ABSTRACT

In at least one embodiment, a weight-bearing health equipment system for use with a user, the user being within the middle 90th percentile of dimensions of a user class. The weight-bearing health equipment system includes a fitness equipment base having a plate having a periphery and extending from a front end to a back end. The weight-bearing health equipment system further includes a framework connected to the plate including a first pair of elongated members, a second pair of elongated members, and a third pair of elongated members connected to the first and second pair of elongated members. The first pair elongated members are adapted to prevent contact with the user when the user enters, exits, or engages the system. The third pair elongated members are adapted to be outside the ergonomic sweep of the user's arms.

20 Claims, 4 Drawing Sheets

(56) References Cited

U.S. PATENT DOCUMENTS

2003/0119633 A1* 6/2003 Jacobs et al. ..... 482/70
2005/0255971 A1 11/2005 Solomon
2007/0155592 A1* 7/2007 Hoag ..... 482/54

* cited by examiner

COMPONENT FOR WEIGHT-BEARING HEALTH EQUIPMENT SYSTEM AND METHOD OF USE

CROSS-REFERENCE TO RELATED APPLICATIONS

This application claims priority to U.S. provisional application Ser. No. 61/429,099 filed Dec. 31, 2010, U.S. provisional application Ser. No. 61/429,100 filed Dec. 31, 2010, and U.S. provisional application Ser. No. 61/429,105 filed Dec. 31, 2010 which are incorporated herein by reference.

FIELD OF THE INVENTION

This invention relates to a component for a weight-bearing health equipment system and its method of use.

BACKGROUND

Kinesiology addresses physiological, mechanical, and psychological mechanisms related to human health. Applications of kinesiology include biomechanics, orthopedics, rehabilitation, and occupational therapy as well as sports and exercise. Weight-bearing health equipment systems are devices for implementing the kinesiological activities including those improving cardiovascular health.

SUMMARY

In at least one embodiment, a weight-bearing health equipment system for use with a user having arms, the user being within the middle 90th percentile of dimensions of a user class includes a fitness equipment base having a back end and a plate having a periphery and extending from the front end to the back end. The system also includes a framework connected to the plate including a first pair of elongated members each having a longitudinal axis and two ends. The first pair of elongated members are spaced apart and opposed on opposite sides of the periphery of the back end of the plate. Each of the first pair of elongated members is situated transversely to the plate with one end connected to the plate about the periphery proximate to the back end. The framework also includes at least one second elongated member having two ends. The second elongated member is situated towards the front end of the plate and transversely positioned to the plate with one end connected to the plate about the periphery proximate to the front end. The framework also includes a third pair of elongated members, each having a longitudinal axis, a middle, a front-facing end and a back-facing end. One of the third elongated members is connected between a second end of one of the first elongated members and the second elongated member. The other third elongated member is connected between the second end of one of the first elongated members and the second elongated member. The pair of first elongated members are configured such that the second ends are disposed closer to one another than the first ends. The first ends of the first elongated member are adapted to prevent contact with the user when the user enters, exits, or engages the system. The longitudinal axis of the third elongated member is adapted to be outside the ergonomic sweep of the user's arms.

In another embodiment, a component for use with a weight-bearing health equipment system includes a fitness equipment base having a plate, a non-movable portion about the periphery of the base, a front end and a back end. The component further includes a framework connected to the plate including a first pair of elongated members each having a longitudinal axis and two ends and a pair of second elongated members. The second elongated members are spaced apart and opposed across the width of the plate. The second elongated members are situated towards the front end of the plate. Each second elongated member is situated transversely to the plate with one end connected to the plate about the periphery proximate to the front end. The framework also includes a third pair of elongated members connected between the first and second elongated members. The component also includes an upwardly extending grab rail situated towards the front end. The grab rail is connected at each front-facing end of the third elongated members. The grab rail is capable of being situated and adapted to be outside the ergonomic sweep of the user's arms just like the third elongated members.

In yet another embodiment, the method of use of a weight-bearing health equipment system capable of having a user within the middle 90th percentile of dimensions of a user class and having at least one arm includes providing a fitness equipment base. The fitness equipment base has a plate with a periphery, a non-movable portion about the periphery of the base. The base also has a front end, a back end and sides. The fitness equipment includes a component having an upwardly directed framework connected at a contact point to the plate, one in the front end and one in the back end. The framework includes two inverted channels that are spaced apart and situated on the non-movable portions of opposing sides of the periphery. The channel defines a truncated frustoconical cavity adapted to be outside the ergonomic sweep of the user's arm. The method also includes providing the user into the cavity and operating a fitness program for the user. During the fitness program, the user swings at least one arm without the arm striking the framework while using the component of the weight-bearing health equipment system.

DETAILED DESCRIPTION

Reference will now be made in detail to presently preferred compositions, embodiments and methods of the present invention, which constitute the best modes of practicing the invention presently known to the inventors. The figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any claims and/or as a representative basis for teaching one skilled in the art to variously employ the present invention.

Except in examples, or where otherwise expressly indicated, all numerical quantities in this description used to indicate amounts of material or dimensions are to be understood as modified by the word "about" in describing the broadest scope of the invention. Practice within the numerical limits stated is generally preferred. Also, unless expressly stated to the contrary: the description of a group or class of materials as suitable or preferred for a given purpose in connection with the invention implies that mixtures of any two or more the members of the group or class are equally suitable for preferred; the first definition of an acronym or other abbreviation applies to all subsequent uses herein of the same abbreviation and applies mutatis mutandis to normal grammatical variations of the initially defined abbreviation; and, unless expressly stated to the contrary measurement of a property is determined by the same technique as previously or later referenced for the same property.

Figure 1:
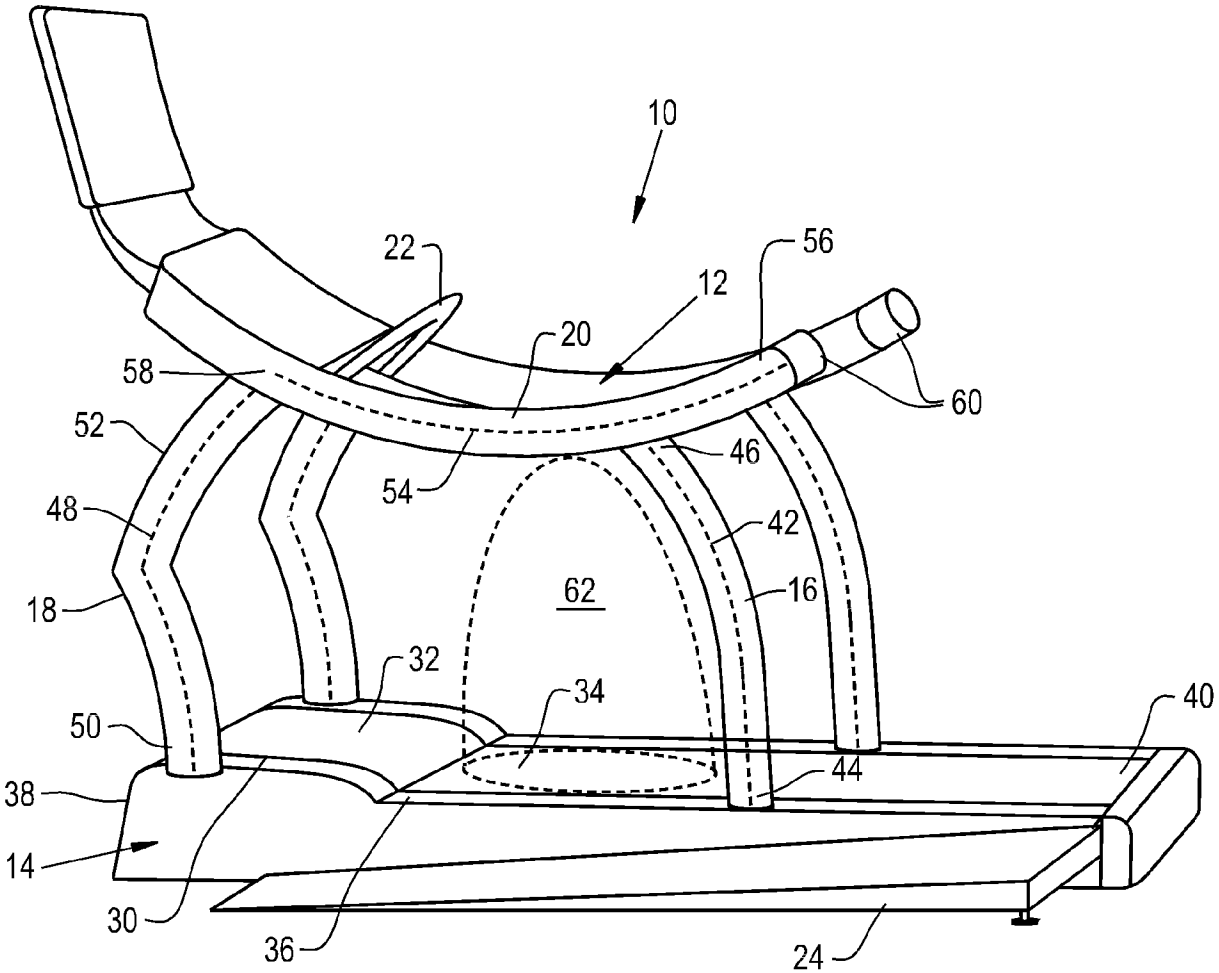
FIG. 1 schematically illustrates an isometric view of a component for use with a weight-bearing health equipment system according to at least one embodiment.

Turning now to FIG. 1, a component 12 of a weight-bearing health system 10 is illustrated in an isometric view according to at least one embodiment. Component 12 includes a base 14, a pair of first upwardly extending elongated members 16, a second pair of upwardly extending elongated members 18, a third pair of elongated members 20 connected to first member 16 and second member 18, and a grab rail 22 connected the third pair of elongated members 20.

Base 14 includes a non-movable portion 30, including a hood 32, a non-movable portion 34, and a plate 36, which, in certain embodiments, includes non-movable portion 30. Base 14 includes a front end 38 and a back end 40. Base 14 has a periphery with a front, back, and sides. In certain embodiments, non-movable portion 34 is situated at the periphery.

Adjacent to base 14 is a ramp 24 suitable for assisting users to enter and exit weight-bearing health equipment system 10. In at least one embodiment, at least one of the third pair of elongated members 20 may also assist the user as a handhold while entering and/or exiting weight-bearing health equipment system 10.

In at least one embodiment, one of the pair of the first elongated members 16 has a longitudinal axis 42 and two ends 44 and 46. End 44 is connected to non-movable portion 30 on the side periphery towards back end 40. The other one of the pair of the first elongated members 16 is connected similarly on the other side periphery. Each of the first pair of elongated members 16 are configured such that the second ends are disposed closer to one another than the first ends. The positioning of the first ends is such that a user when entering, exiting or engaging the system 10 does not contact the first elongated member, such as tripping over the end, during the course of normal motion of the user's feet.

In at least one embodiment, the longitudinal axis of the first elongated member has a radius ranging from 35 to 50 inches relative to the front end 38. In another embodiment, the longitudinal axis of the first elongated member has a radius ranging from 40 to 46 inches relative to the front end.

In at least one embodiment, one of the pair of the second elongated members 18 has a longitudinal axis 48 and two ends 50 and 52. End 50 is connected to non-movable portion 30 on the side periphery towards front end 38. The other one of the pair of second elongated members 18 is connected similarly on the other side periphery. Each of the second ends 52 of the second elongated members 18 is situated outboard of the second ends 46 of the first elongated members 16.

In at least one embodiment, one of the third pair of elongated members 20 having a longitudinal axis 54, a middle point, a back end 56, and a front end 58 is connected near the back end 56 to second end 46 of the first elongated member 16. Member 20 is also connected at front end 58 to second end 52 of second elongated member 18. The combination of elongated members 16, 18, and 20 form a framework, in at least one embodiment, that defines a cavity 62 which defines a revolved truncated frustoconical shape. In another embodiment, the combination of elongated members 16, 18, and 20 form a framework, in at least one embodiment, that defines a cavity 62 which defines a pyramidal shape. In yet another embodiment, the combination of elongated members 16, 18, and 20 form a framework, in at least one embodiment, that defines a cavity 62 which defines a combined shape of a revolved truncated frustoconical shape and a pyramidal shape.

A center of gravity for cavity 62 defines a central station for the health equipment system 10. In at least one embodiment, the central station is forward from the position of a central station in traditional health equipment systems. The position of the central station in its forward position works in relationship with grab rail 22 and third elongated member 20 to maximize the safety of the user by preventing contact with non-movable portion 30 and/or hood 32.

In at least one embodiment, the third pair of elongated members 18 are shaped along the elongated axis 54 such that the user in a particular user class do not strike the third pair of elongated members 18 when sweeping the user's arms. This allows increased range of motion during exercise or rehabilitation, particularly exercises that involve the use of rackets or other exercise implements, such as weights or game controllers.

In at least one embodiment, the longitudinal axis 54 of the third elongated member 18 has a downward extending radius ranging from 35 inches to 50 inches. In another embodiment, the longitudinal axis 54 of the third elongated member 18 has a downward extending radius ranging from 40 to 46 inches.

In at least one embodiment, the middle of the third elongated member 18 at the longitudinal axis 54 ranges from 4 to 10 inches lower than the longitudinal axis at back end 56, where it is covered by a cap 60. In another embodiment, the middle of the third elongated member 18 at the longitudinal axis 54 ranges from 5 to 8 inches lower than the longitudinal axis 54 at back end 56, where it is covered by the cap 60. In yet another embodiment, the middle of the third elongated member 18 at the longitudinal axis 54 ranges from 4.5 to 7 inches lower than the longitudinal axis 54 at back end 56, where it is covered by the cap 60. In at least one embodiment, the average arm when fully extended, is at least 1 inch above the third elongated member 18.

In at least one embodiment, the back ends 56 of third elongated member 20 are situated apart by distance ranging from 20 to 28 inches. In another embodiment, the pair of back and 56 are situated apart by distance ranging from 21 to 25 inches. Such a distance is adapted to receive readily the user while providing partial enclosure such that the user can reach the elongated member 20 in the event user begins to fall off the back end of health equipment system 10.

In at least one embodiment, the pair of front ends 58 of the third elongated member 20 are further apart than the pair of back ends 56 by a range from 2 inches to 8 inches. In another embodiment, the pair of front ends 58 of the third elongated member 20 are further apart than the pair of back ends 56 by a range from 4 inches to 6 inches.

In at least one embodiment, the longitudinal axis 54 of third elongated member 20 when viewed from the top is straight. In another embodiment, the longitudinal axis 54 of third elongated member 20 when viewed from the top is convex.

In certain embodiments above, the user is selected from the "normal" user class which is based on ergonomic data for the United States population. In certain other embodiments, user class may be selected from the athletic user class or the child-senior user class. Standardized height and arm reach ranges for each class are given in Table 1. The middle 90th percentile of each user class is determined by using the 95th percentile and the 5th percentile. It is understood that the first and second elongated members may be fixed in dimension and have a predetermined length in certain embodiments, and in other embodiments the first and second elongated members may be adjustable.

TABLE 1

| User Class | Average height | Height at Fingertips | Minimum Third Elongated Member Height |
|---|---|---|---|
| Athletic | 75" | 28.05" | 30" |
| Average | | | |
| $95^{th}$ percentile | 82.6" | 39.6" | 30" |
| $5^{th}$ percentile | 68.8" | 24.9" | 30" |
| Normal | 66" | 24.88" | 27" |
| Average | | | |
| $95^{th}$ percentile | 73.6 | 36.5" | 27" |
| $5^{th}$ percentile | 59.8 | 18.7" | 27" |
| Child-Senior | 62" | 23.37" | 24" |
| Average | | | |
| $95^{th}$ percentile | 69.6" | 32.5" | 24" |
| $5^{th}$ percentile | 55.8" | 14.7" | 24" |

Walking and running exercises usually increase the height of the fingertips 2" to 3" higher than when at rest, such as given in Table 1. The middle 90th percentile dimensions of a user class, in certain embodiments, are defined in terms of curled fingertips, which increases the fingertip height by at least inches relative to the values in the table.

Figure 2:
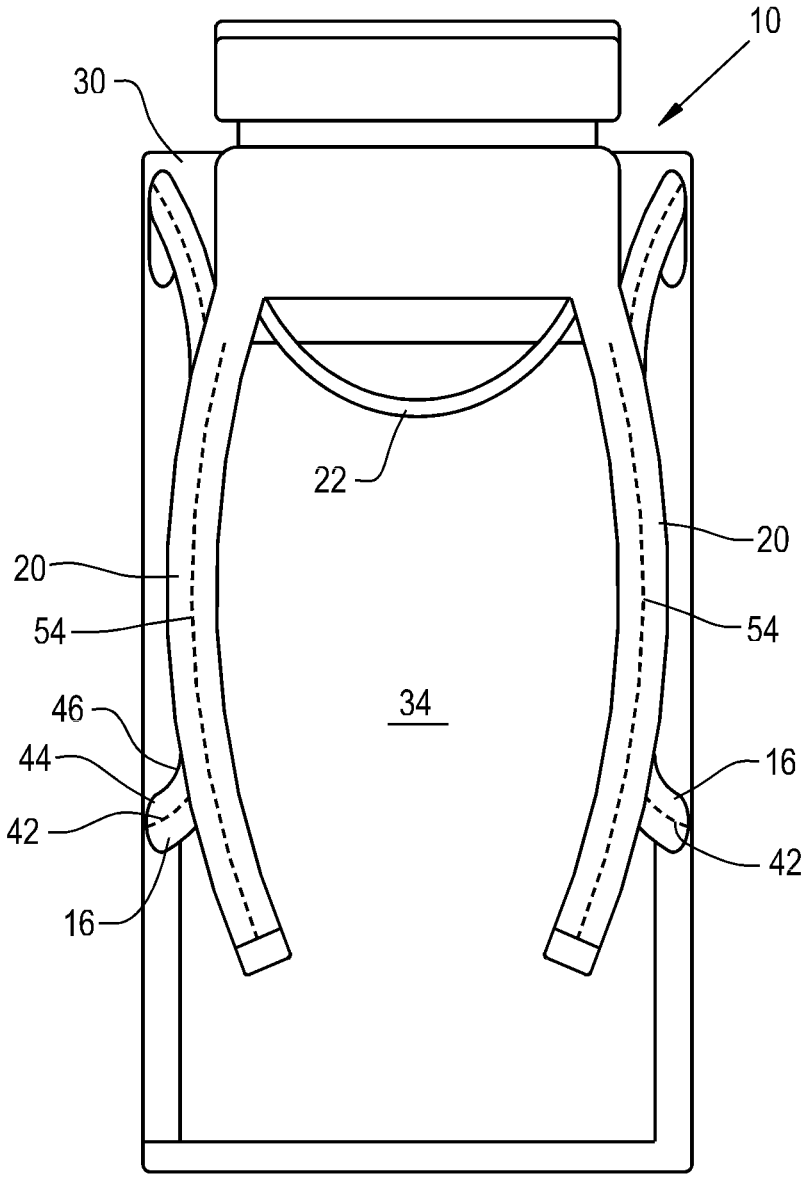
FIG. 2 schematically illustrates a top view of one embodiment of a component for use with a weight-bearing health equipment system according to at least one embodiment.

Turning now to FIG. 2, a top view of health equipment system 10 is schematically illustrated. Longitudinal axis 54 is schematically illustrated as being convex according to at least one embodiment. In another embodiment, longitudinal axis 54 is straight in the top view. In yet another embodiment, longitudinal axis 54 is a combination of straight and curved sections. In yet another embodiment, longitudinal axis 54 may include articulated sections.

At least one embodiment, longitudinal axis 42 is schematically illustrated as curved with end 44 extending outwardly relative to end 46. In another embodiment, longitudinal axis 42 may be straight with end 44 extending outwardly relative to end 46. In yet another embodiment, longitudinal axis 42 is a combination of straight and curved sections with end 44 extending outwardly relative to end 46. In yet another embodiment, longitudinal axis 42 may be articulated with end 44 extending outwardly relative to end 46.

Figure 3:
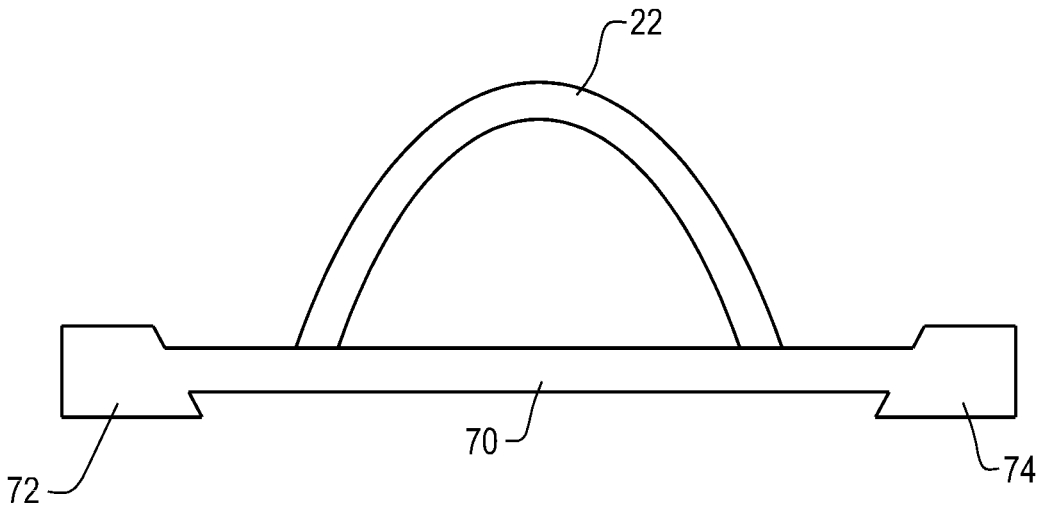
FIG. 3 schematically illustrates a grab handle of a component for use with a weight-bearing health system according to at least one embodiment.

Turning now to FIG. 3, grab rail 22 is illustrated in a frontal view and is connected to bar 70. Bar 70 has two ends 72 and 74, one end is connected to at least one of the third elongated member 20 or second elongated member 18. The other end of bar 70 is connected similarly to the other side to at least one of the second or third elongated member. Grab rail 22, in at least one embodiment, has an angle relative to a perpendicular line from ground ran ranging from 55° to 45°. In another embodiment, grab rail 22 has an angle relative to the perpendicular line from the ground ranging from 52° to 48°. It is understood that the angle relative to a perpendicular line from the ground may be predetermined and/or adjustable. In certain embodiments, the adjustability may include preset increments.

In at least one embodiment, the distance from an apex of grab rail 22 to plate 36 ranges from 42" to 48". In another embodiment, the distance from an apex of grab rail 22 to plate 36 ranges from 44" to 46".

Figure 4:
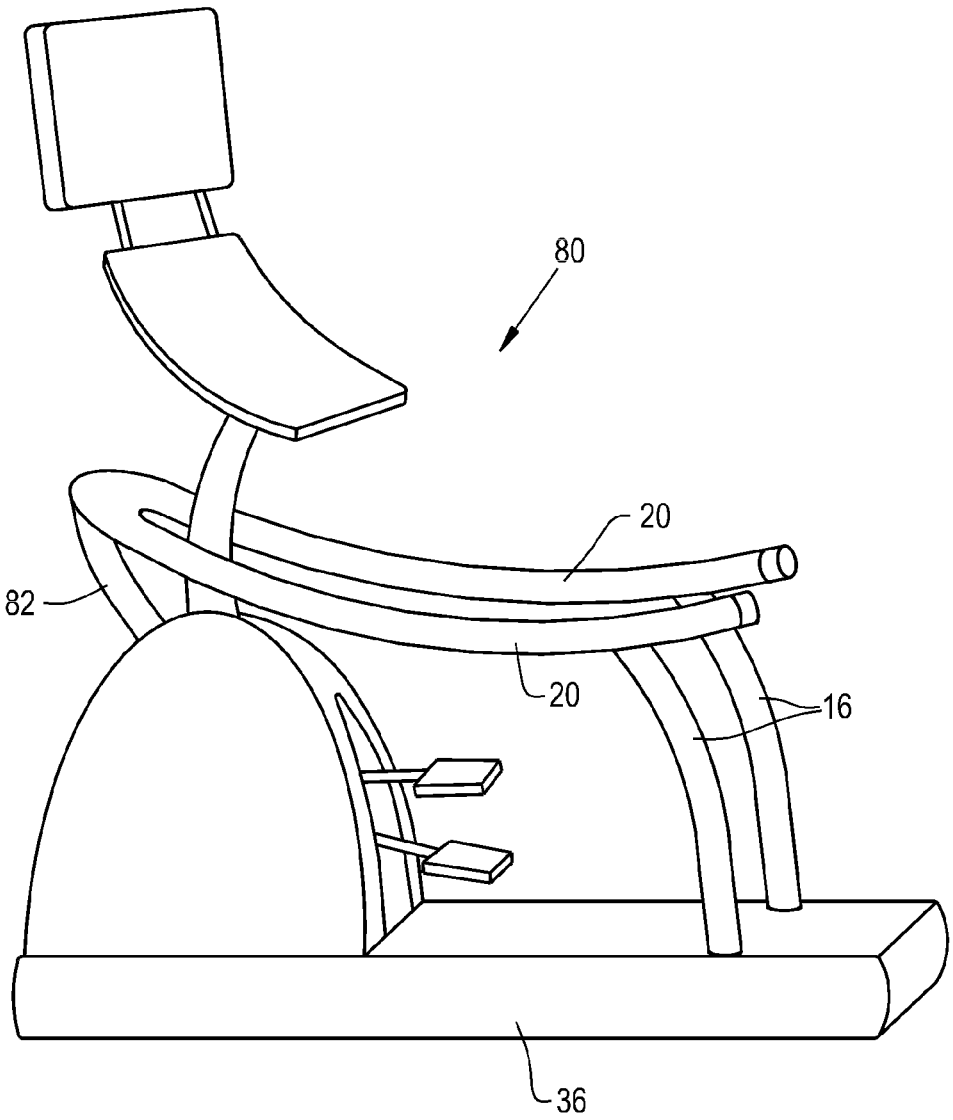
FIG. 4 schematically illustrates an isometric view of another embodiment of a component for use with a weight-bearing health system.

Turning now to FIG. 4, a step exercise piece 80 of health equipment system is illustrated schematically according to at least one embodiment. In at least one embodiment, an alternative embodiment of a second elongated member 82 is illustrated. Third elongated members 20 are connected to first elongated members 16 on each side of the plate 36. But, the third elongated members 20 are joined with only one second elongated member 82 situated at the front end of the step exercise piece 80. It is understood that while a treadmill and a step exercise piece 80 have been illustrated, they are merely exemplary of health equipment systems. Other non-limiting examples of health equipment systems include a total body exercise non-weight bearing health equipment system, an elliptical trainer, a body vibration machine, and a total body arc machine.

The method of use of a weight-bearing health equipment system 10 having a user within the middle 90th percentile dimensions of a user class includes providing the fitness equipment base 12 having the plate 36 with the periphery. The base has the non-movable portion 30 about the periphery of the base 12 as well as having a front end 38, a back end 40, and sides. The fitness equipment base 12 includes having upwardly directed framework connected at contact points to the plate in the front end the back end. The framework includes two inverted channels that are spaced apart and situated on the non-movable portions on opposing side periphery. The channels define a revolved truncated frusto-conical cavity 62 adapted to be outside the ergonomic sweep of the user's arm. The user is present. A fitness program is operated for the user such that the user swings at least one arm without the arm striking the framework while using the component of the weight-bearing health equipment system 10.

The method can also include providing a ramp 24 outwardly extending from the periphery of the plate 36 and having the user enter the cavity 62 by ascending the ramp 24 such that the user does not strike the framework at contact point with the base.

The method is also intended for use wherein the framework is adaptable for the user class. User class may be selected from a group consisting of an athlete class, a normal class, and a child-senior class. It is understood that other classes may developed or the dimensions parsed differently without exceeding the scope or spirit of the embodiments.

All exemplary embodiments are described above, it is not intended that these embodiments describe all possible forms of the invention. Rather the, the words used in the specification awards a description rather than limitation, and it is understood that various changes may be made without departing from the spirit and scope of the invention. Additionally, the features of the various embodiments may be combined to form further embodiments of the invention.

What is claimed is:

1. A weight-bearing health equipment system for use with a user having arms and legs, the user being within the middle 90th percentile of dimensions of a user class, the weight-bearing health equipment system comprising:

a fitness equipment base having a plate having a periphery and extending from a front end to a back end; and a framework connected to the plate including a first pair of elongated members each having a longitudinal axis and two ends, the first pair of elongated members being spaced apart on opposite sides of the periphery of the back end of the plate, the first pair of elongated members situated transversely to the plate with one end connected to the plate about the periphery proximate to the back end;

at least one second elongated member having two ends, the second elongated member being situated towards the front end of the plate and being situated transversely to the plate with one end connected to the plate about the periphery proximate to the front end; and a third pair of elongated members, each having a longitudinal axis, a middle, a front-facing end and a back-facing end, the middle being situated lower than the front-facing end and the back-facing end, one of the third elongated members being connected to a second end of a respective said first elongated member and a respective said second elongated member, the other third elongated member being connected to a second end of a respective said first elongated member and the second elongated member, wherein the first pair of elongated members are configured such that the second ends are disposed closer to one another than the first ends, the first ends of each said first elongated member being adapted to prevent contact with the user when the user enters, exits, or engages the system, wherein a distance between the front-facing ends of the third pair of elongated members is greater than a distance between the back-facing ends, the longitudinal axis of each of the third elongated members having a compound curvature which curves down from the front-facing end to the middle and curves up from the middle to the back-facing end when viewed from a side view and curves out from the front-facing end to the middle and curves in from the middle to the back-facing end when viewed from a top view, and thereby being adapted to be outside the ergonomic sweep of the user's arms.

2. The weight-bearing health equipment system of claim 1, further comprising an upwardly extending grab rail situated towards the front end, the grab rail connected to the front-facing ends of the third elongated members, wherein the grab rail is capable of being situated and adapted to be outside the ergonomic sweep of the user's arms.

3. The weight-bearing health equipment system of claim 2, wherein the base includes a non-movable portion adjacent to the front end, a movable portion disposed within the non-movable portion, and the grab rail situated to be capable of preventing the user's legs from striking the non-movable portion of the front end when the user uses the system.

4. The weight-bearing health equipment system of claim 1, wherein the longitudinal axis of the third elongated member has a curvature with a radius ranging from 35 inches to 50 inches.

5. The weight-bearing health equipment system of claim 1, wherein the longitudinal axis of the first elongated member has a curvature with a radius ranging from 35 inches to 50 inches relative to the front end.

6. The weight-bearing health equipment system of claim 1, wherein a middle of the longitudinal axis of the third elongated member is situated lower than the longitudinal axis at the back-facing end by an amount ranging from 4 inches to 10 inches.

7. The weight-bearing health equipment system of claim 1, wherein the distance between the back-facing ends of the third elongated members ranges from 20 inches to 28 inches.

8. The weight-bearing health equipment system of claim 7, wherein the distance between the front-facing ends of the third pair of elongated members is greater than the distance between the back-facing ends of the third elongated member by a range from 2 inches to 8 inches.

9. The weight-bearing health equipment system of claim 1, wherein the base includes a non-movable portion, a movable portion disposed within the non-movable portion, the first pair of elongated members being situated to be capable of preventing the user's legs from striking the non-movable portion at the back end.

10. The weight-bearing health equipment system of claim 1, further comprising an entry ramp situated adjacent to the base, wherein the framework is capable of supporting the user when entering and exiting the system.

11. A weight-bearing health equipment system for use with a user with at least one arm and leg, the user being within the middle 90th percentile of dimensions of a user class, the component comprising:

a fitness equipment base having a plate and a non-movable portion about a periphery of the plate, the plate having a front end and a back end; and a framework connected to the plate including a first pair of elongated members each having a longitudinal axis and a first end and a second end, the first pair of elongated members being spaced apart and opposed on opposite sides of the periphery of the back end of the plate, each elongated member situated transversely to the plate with one end connected to the plate about the periphery proximate to the back end;

a pair of second elongated members having a front-facing end and a back-facing end, the second elongated members being spaced apart and opposed across the plate, each of the second elongated members being situated towards the front end of the plate and being situated transversely to the plate with one end connected to the plate about the periphery proximate to the front end;

a third pair of elongated members, each having a longitudinal axis, a middle, a front-facing end and a back-facing end, the middle being situated lower than the front-facing end and the back-facing end, one of the third elongated members being connected to a second end of the first elongated member and the second elongated member, the other third elongated member being connected to a second end of the first elongated member and the second elongated member; and an upwardly extending grab rail situated towards the front end, the grab rail connected at each front-facing end of at least one of the second or third elongated members, wherein the grab rail is capable of being situated and adapted to be outside the ergonomic sweep of the user's arms, wherein the first ends of the first elongated member being adapted to prevent contact with the user when the user enters, exits, or engages the system, wherein a distance between the front-facing ends of the third pair of elongated members is greater than a distance between the back-facing ends, the longitudinal axis of each of the third elongated members having a compound curvature which curves down from the front-facing end to the middle and curves up from the middle to the back-facing end when viewed from a side view and curves out from the front-facing end to the middle and curves in from the middle to the back-facing end when viewed from a top view, and thereby being adapted to be outside the ergonomic sweep of the user's arms.

12. The weight-bearing health equipment system of claim 11, wherein the system further comprises:

an upwardly extending post situated at the front end of the plate; and at least two foot pads movably connected to the upwardly extending post.

13. The weight-bearing health equipment system of claim 11, wherein the third pair of elongated members are adapted to be outside the ergonomic sweep of the user's arms when at least one arm is holding a racket.

14. The weight-bearing health equipment system of claim 11, wherein at least one of the first, second, or third elongated members is articulated.

15. The weight-bearing health equipment system of claim, 11, wherein the longitudinal axis of the first elongated member has a curvature with a radius ranging from 40 inches to 46 inches, and the middle of the longitudinal axis of the third elongated member is situated lower than the longitudinal axis at the back-facing end by an amount ranging from 4.5 inches to 7 inches.

16. The weight-bearing health equipment system of claim 11, wherein the framework defines a cavity shaped as a revolved truncated frustoconical section adapted to be outside the ergonomic sweep of the user's arm during a stationary exercise or a running exercise.

17. The weight-bearing health equipment system of claim 11, wherein dimensions of the framework are capable of being dimensionally set for a user selected from a class consisting of an athlete class, a normal class, and a child-senior class.

18. A method of use of a weight-bearing health equipment system capable of having a user within the middle 90th percentile of dimensions of a user class and having at least one arm and leg, the method comprising the steps of:

providing a fitness equipment base having a plate with a periphery, a non-movable portion about the periphery of the plate, the base having a front end, a back end and sides, the fitness equipment including an upwardly directed framework connected to the front end and the back end of the non-movable portion, the upwardly directed framework attached to the non-movable portion on opposite sides of the periphery, the upwardly directed framework having a pair of substantially horizontal elongated members each including a longitudinal axis, a middle, a front-facing end and a back-facing end, the middle being situated lower than both of the front-facing end and the back-facing end, wherein a distance between the front-facing ends is greater than a distance between the back-facing ends, the longitudinal axis of each of the third elongated members having a compound curvature which curves down from the front-facing end to the middle and curves up from the middle to the back-facing end when viewed from a side view and curves out from the front-facing end to the middle and curves in from the middle to the back-facing end when viewed from a top view, the upwardly directed framework defining a truncated frustoconical cavity adapted to be outside the ergonomic sweep of the user's arm;

providing the user into the truncated frustroconical cavity; and operating a fitness program for the user such that the user swings at least one arm in a front to rear or side to side manner without the arm striking the upwardly directed framework while using the weight-bearing health equipment system.

19. The method of claim 18, further including the steps comprising:

providing a ramp outwardly extending from the periphery of the plate; and having the user enter the cavity by ascending the ramp such that the user does not strike the upwardly directed framework at the contact point with base.

20. The method of claim 18, wherein the upwardly directed framework is adaptable for the user class consisting of an athlete class, a normal class, and a child-senior class.

* * * * *